United States Patent [19]

O'Neil

[11] 4,254,712

[45] Mar. 10, 1981

[54] RAILWAY TRUCK SIDE FRAME WEAR PLATE MOUNTING

[75] Inventor: Gerald D. O'Neil, S. Holland, Ill.

[73] Assignee: AMSTED Industries Incorporated, Chicago, Ill.

[21] Appl. No.: 86,932

[22] Filed: Oct. 22, 1979

[51] Int. Cl.[3] ..... B61F 5/12; B61F 5/50; F16D 69/04

[52] U.S. Cl. ..... 105/197 DB; 105/197 D; 105/207

[58] Field of Search ..... 105/197 D, 197 DB, 207, 105/225

[56] References Cited

U.S. PATENT DOCUMENTS

| | | | |
|---|---|---|---|
| 3,408,955 | 11/1968 | Barber | 105/197 DB |
| 3,687,086 | 8/1972 | Barber | 105/207 X |
| 3,834,320 | 9/1974 | Tack | 105/197 D |
| 3,880,089 | 4/1975 | Wallace | 105/197 DB |

*Primary Examiner*—Howard Beltran

*Attorney, Agent, or Firm*—Edward J. Broisus; Fred P. Kostka; John L. Schmitt

[57] ABSTRACT

A wearplate for a column of a railway freight car side frame is attached by fastener means to a column web and additionally is welded to top and bottom lugs of the column web by weld metal in recesses of said lugs and in recesses of the web which communicate with the lug recesses at the side of the plate which seats against the web.

1 Claim, 5 Drawing Figures

RAILWAY TRUCK SIDE FRAME WEAR PLATE MOUNTING

This invention relates to a railway freight car side frame and more particularly to a novel attachment for a wearplate which is frictionally engaged in well-known manner with a friction device, such as a friction shoe, which is urged against the wearplate, as by wedge surfaces of a conventional bolster spring-supported in the usual manner by the side frame and in turn affording support for a freight car body.

According to prior art practices, such wearplates have been attached to a web of a side frame column by mechanical fasteners extending through openings of the wearplate and web. Top and bottom lugs of the web and inboard and outboard lugs of the web confine the wearplate at a spacing between each lug and the wearplate of the order of 3/32 of an inch. Secondary fastening means for the plate have been achieved by weld metal fusing the top and bottom of the wearplate to the facing surfaces of the top and bottom lugs or by welding the web to the wearplate at the four corners of the latter along its edges.

In the case of corner welding, the plates have been longer than those used where the secondary fastening was achieved by welding of the wearplate to the top and bottom lugs, because the shorter wearplates provided adequate space for the reception of weld metal. This practice required carbuilders and railway yards to stock wearplates of two different lengths, resulting in inventory problems and the risk of misapplication of wearplates.

Accordingly, a primary object of the invention is to eliminate the necessity for wearplates of different lengths by devising a secondary fastening weld between the plate and the top and bottom stop lugs on column web which would accommodate a common length plate. Thus the same plate can be used either for corner welding or for welding to the top and bottom lugs.

The foregoing and other objects and advantages of the invention will become apparent from the following specification and the accompanying drawings, wherein.

Figure 1:
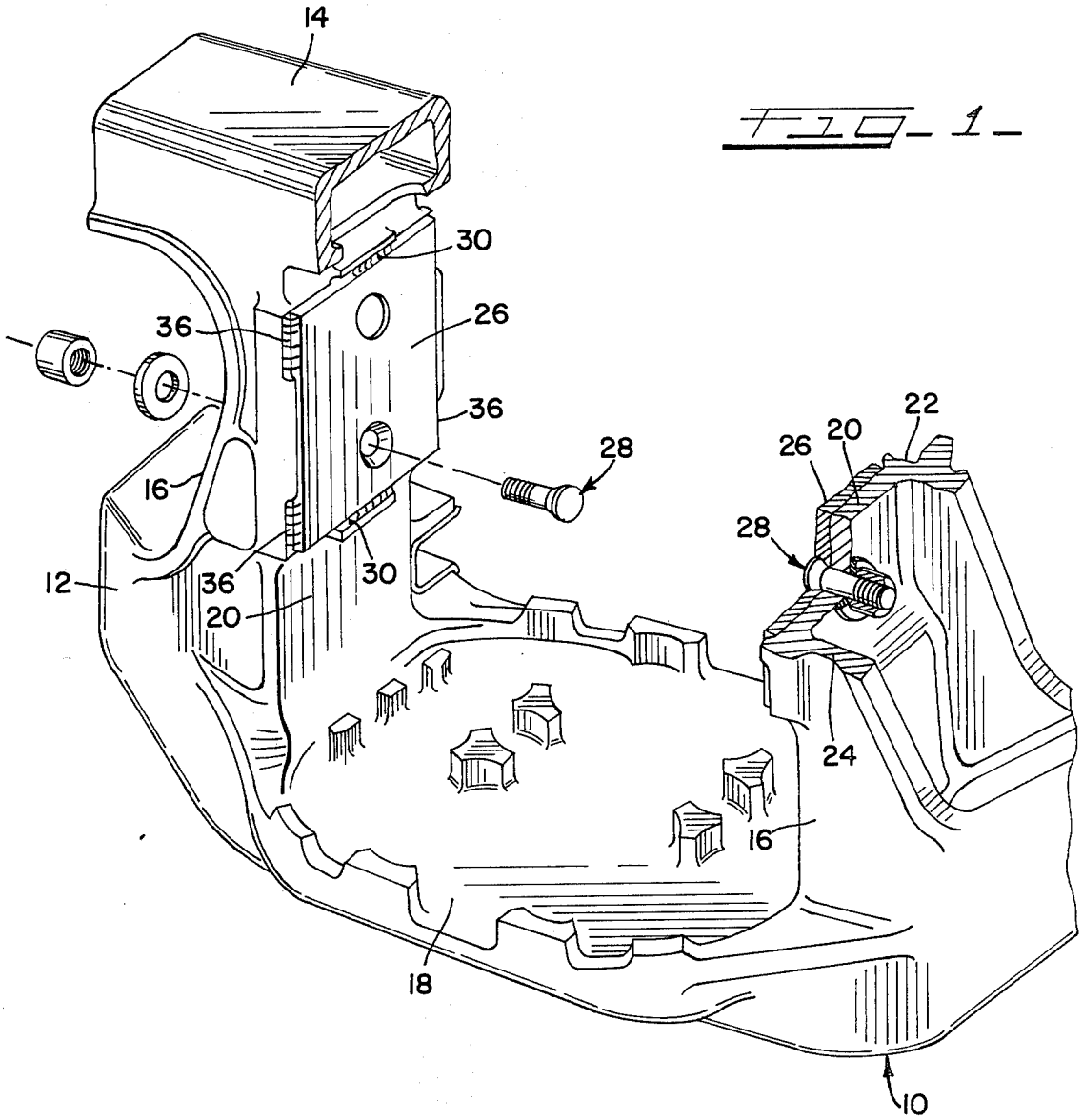
FIG. 1 is a fragmentary side elevational view of a truss type railway car truck side frame embodying a preferred form of the invention.

Describing the invention in detail and referring first to FIGS. 1–4, a preferred embodiment of the invention is disclosed as embodied in a well-known truss type of railway freight car side frame generally designated 10 (FIG. 1) which comprises tension and compression members 12 and 14 with portions broken away for the sake of clarity. These members are interconnected in the usual manner by integral spaced columns 16 at opposite ends of a spring seat 18 on the tension member.

Each column comprises a transversely extending web 20 extending from an inboard column web 22 to an outboard column web 24. A wearplate 26 is attached to the transverse web 20 as by spaced conventional mechanical fasteners 28 and by top and bottom welds 30 hereinafter more particularly described.

As is well known in the art, a conventional car-supporting bolster (not shown) is supported by springs (not shown) on spring seat 18 and actuates friction devices (not shown) against the wearplates 26.

Figure 2:
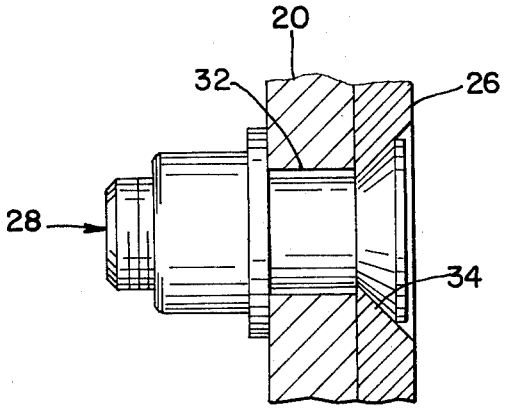
FIG. 2 is a sectional view through the column web and wearplate fastener holes, with a fastener shown in elevational view.

The fasteners, as best seen in FIG. 2, extend through holes 32 and 24 of the web 20 and wearplate 26, respectively, with the fastener head counter-sunk in the wearplate 26 as best seen at the right of FIG. 2.

If desired, the welding at 30 may be eliminated and in lieu thereof each plate 26 may be welded to the web 20 at the four corners of the late as at 36 (FIG. 1).

Figure 4:
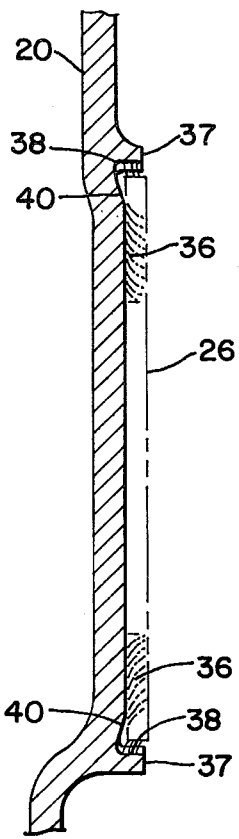
FIG. 4 is a sectional view on line 4—4 of FIG. 3.
Figure 3:
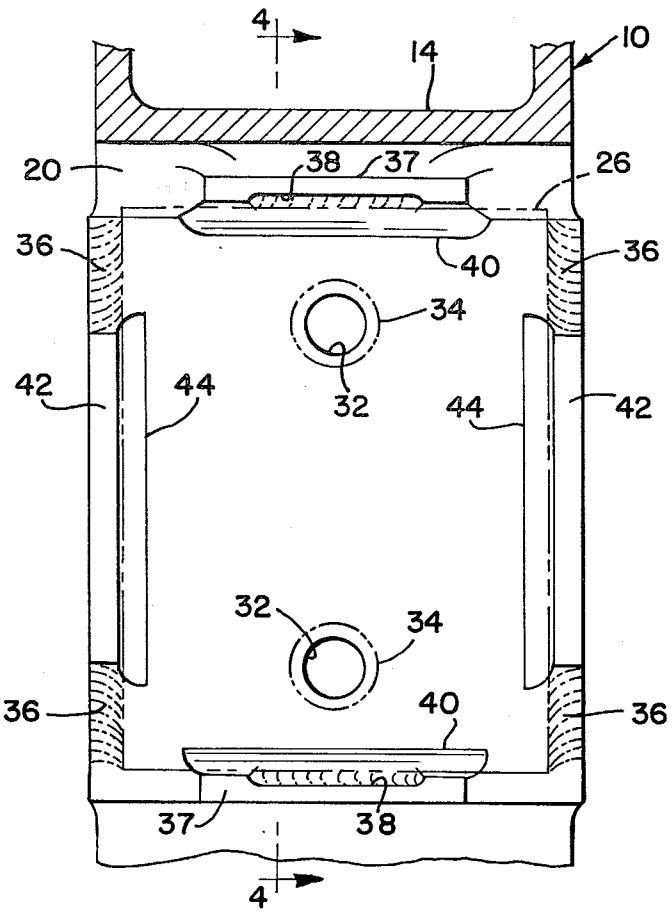
FIG. 3 is a fragmentary front elevational view of the left-hand side frame column in FIG. 1, with the fasteners removed and the wearplate shown in phantom lines.

FIGS. 3 and 4 show the left-hand column web 20 of FIG. 1 in detail, with the wearplate 26 shown in phantom lines. In these Figs., it will be seen that the web 20 comprises top and bottom lugs 37 recessed at 38 and these recesses merge with recesses 40 of the web 20 so that the plate may be welded at 30 (FIG. 1) to the top and bottom lugs by weld metal filling recesses 38 and 40 (FIGS. 3 and 4) and fusing the plate 26 at one end thereof to a lug 37 and at the backside of the plate 26 to the web 20.

The inboard and outboard sides of the plate in this embodiment are confined between inboard and outboard lugs 42 each of which merges with the plate along a recess 44 of the web. The lugs 42 are not recessed in this embodiment because they are not welded to the plate 26.

Figure 5:
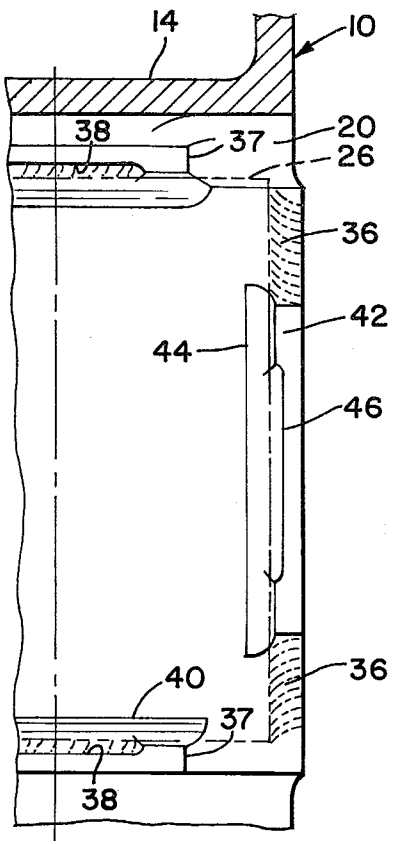
FIG. 5 is a fragmentary view comparable to the right half of FIG. 3 but showing a modification of the invention.

FIG. 5 shows a modification which is the same as that shown in FIGS. 1–4 except that inboard and outboard lugs 42 are recessed at 46 in the same manner as top and bottom lugs 37 and for the same purpose, that is to receive weld metal for additional attachment of the plate 26 to the web. Other parts shown in FIG. 5 correspond to those of FIG. 3 and are identified by corresponding numerals. The modification of FIG. 5 may be used with fasteners as shown in FIG. 1 or with corner-welding at 36 or both. Also, the modification of FIG. 5 may be used without fasteners or corner-welding.

In the event of failure of the fasteners 28 and the weld metal so that the wearplate becomes loose from web 20, the plate 26 is held against its column web 20 by the friction device (not shown) heretofore mentioned; and vertical movement of the plate 26 is limited to the order of 3/16 of an inch because the spacing of the plate 26 from each top and bottom lug 37 is of the order of 3/32 an inch. Also under such circumstances inboard and outboard movement of the plate 26 is also limited to the order of 3/16 of an inch because the spacing of plate 26 from each lug 42 is of the order of 3/32 of an inch.

What is claimed is:

1. A railway freight car truck side frame including a column web extending transversely of the frame, top and bottom wear plate stop lugs projecting from said web, a wear plate seated against said web between said lugs and spaced slightly from each lug, an elongated recess in each lug between its inboard and outboard ends and facing the wear plate, corresponding elongated recesses in the web behind the plate, weld metal in both of said recesses fusing the plate to the web and lugs, fasteners and aligned holes in said plate and said web whereby said fasteners extend through said aligned holes to further attach said plate to said web, whereby in the event of the failure of said fasteners and of said weld metal, vertical movement of the plate between said lugs is limited by the top and bottom lugs, and inboard and outboard elongated wear plate stop lugs on said web, said wear plate being located between said lugs and spaced slightly from each lug, an elongated recess in each lug between its ends and facing the wear plate, corresponding mating elongated recesses in the web behind the plate, weld metal in both of said recesses fusing the plate to the web and lugs, whereby in the event of the failure of said fasteners and of said weld metal, horizontal movement of the plate between said lugs is limited by the inboard and outboard lugs.

* * * * *